US011898259B2

(12) United States Patent
Konig et al.

(10) Patent No.: US 11,898,259 B2
(45) Date of Patent: Feb. 13, 2024

(54) ELECTROCHEMICAL $CO_2$ CONVERSION

(71) Applicant: VITO NV, Mol (BE)

(72) Inventors: Maximilian Konig, Mol (BE); Metin Bulut, Mol (BE); Jan Vaes, Mol (BE); Elias Klemm, Stuttgart (DE); Deepak Pant, Mol (BE)

(73) Assignee: Vito NV, Mol (BE)

( * ) Notice: Subject to any disclaimer, the term of this patent is extended or adjusted under 35 U.S.C. 154(b) by 0 days.

(21) Appl. No.: 17/778,995

(22) PCT Filed: Nov. 27, 2020

(86) PCT No.: PCT/EP2020/083646

§ 371 (c)(1),
(2) Date: May 23, 2022

(87) PCT Pub. No.: WO2021/110552

PCT Pub. Date: Jun. 10, 2021

(65) Prior Publication Data

US 2023/0349054 A1 Nov. 2, 2023

(30) Foreign Application Priority Data

Dec. 2, 2019 (EP) ..... 19213008

(51) Int. Cl.
*C25B 3/26* (2021.01)
*C25B 3/07* (2021.01)
(Continued)

(52) U.S. Cl.
CPC ..... *C25B 3/26* (2021.01); *C25B 3/07* (2021.01); *C25B 9/17* (2021.01); *C25B 11/032* (2021.01); *C25B 11/037* (2021.01); *C25B 11/065* (2021.01); *C25B 11/081* (2021.01); *C25B 11/091* (2021.01); *C25B 15/08* (2013.01)

(58) Field of Classification Search
None
See application file for complete search history.

(56) References Cited

U.S. PATENT DOCUMENTS 3,720,591 A 3/1973 Skarlos
4,474,652 A 10/1984 Brown et al.
(Continued)

FOREIGN PATENT DOCUMENTS

DE 23 01 032 A1 7/1974
WO 2019141827 A1 7/2019

OTHER PUBLICATIONS

Whipple et al. (Electrochemical and Solid-State Letters, 13 '9' B109-B111 '2010') (Year: 2010).*
(Continued)

*Primary Examiner* — Wojciech Haske
(74) *Attorney, Agent, or Firm* — Dinsmore & Shohl LLP

(57) ABSTRACT

The present invention is related to the electrochemical conversion of $CO_2$ and provides the use of Gas Diffusion Electrode with an aprotic solvent in such conversion of $CO_2$ as well as an electrochemical cell for use in such conversion. The application and electrochemical cell as herein provided are particularly useful in the conversion of $CO_2$ into oxalate/oxalic acid.

20 Claims, 7 Drawing Sheets

(51) Int. Cl.

| | |
|---|---|
| ***C25B 11/037*** | (2021.01) |
| ***C25B 11/032*** | (2021.01) |
| ***C25B 15/08*** | (2006.01) |
| ***C25B 11/091*** | (2021.01) |
| ***C25B 9/17*** | (2021.01) |
| ***C25B 11/081*** | (2021.01) |
| ***C25B 11/065*** | (2021.01) |

(56) References Cited

U.S. PATENT DOCUMENTS

| | | | |
|---|---|---|---|
| 4,673,473 | A | 6/1987 | Ang et al. |
| 8,592,633 | B2 | 11/2013 | Cole et al. |
| 9,267,212 | B2 | 2/2016 | Twardowski et al. |
| 2019/0017183 | A1 | 1/2019 | Cole et al. |
| 2019/0153606 | A1 | 5/2019 | Shin et al. |

OTHER PUBLICATIONS

König et al. ("Solvents and Supporting Electrolytes in the Electrocatalytic Reduction of CO2" iScience 19, 135-160, Sep. 27, 2019) (Year: 2019).*

"Plastics—the Facts 2019," An analysis of European plastics production, demand and waste data, 2019, pp. 1-42, Published on the occasion of the special show of K 2019, a project of the German plastics industry under the leadership of PlasticsEurope Deutschland e. V. and Messe Düsseldorf, 2019 PlasticsEurope.

Timothy C. Berto et al., Electrolyte Dependence of CO2 Electroreduction: Tetraalkylammonium Ions Are Not Electrocatalysts, ACS Cata/., vol. 5, No. 2, pp. 703-707, 2015.

Timothy C. Berto et al., Electrolyte Dependence of CO2 Electroreduction: Tetraalkylammonium Ions Are Not Electrocatalysts, ACS Catal., 2015, pp. 703-707, vol. 5, No. 2.

Aubrey R. Paris et al., High-Efficiency Conversion of CO2 to Oxalate in Water is Possible Using a Cr—Ga Oxide Electrocatalyst, ACS Catal., 2019, pp. 2324-2333,vol. 9, No. 3.

Armando Gennaro et al., Mechanism of the electrochemical reduction of carbon dioxide at inert electrodes in media of low proton availability, J. Chem. Soc., Faraday Trans., 1996, pp. 3963-3968, vol. 92, No. 20.

Shoichiro Ikeda et al., Selective formation of formic acid, oxalic acid, and carbon monoxide by electrochemical reduction of carbon dioxide, Bull. Chem. Soc. Jpn., 1987, pp. 2517-2522, vol. 60.

J. Fischer et al., The production of oxalic acid from CO2 and H2O, J. Appl. Electrochem., 1981, pp. 743-750, vol. 11.

Raja Angamuthu et al., Electrocatalytic CO2 Conversion to Oxalate by a Copper Complex, Science, Jan. 2010, pp. 313-315, vol. 327, No. 5963.

International Search Report issued in the corresponding PCT/EP2020/083646 application dated Jan. 29, 2021.

* cited by examiner

ELECTROCHEMICAL $CO_2$ CONVERSION

CROSS REFERENCES TO RELATED APPLICATIONS

This application is a national-stage application under 35 U.S.C. § 371 of International Application No. PCT/EP2020/083646, filed Nov. 27, 2020, which International Application claims benefit of priority to European Patent Application No. 19213008.6, filed Dec. 2, 2019.

TECHNICAL FIELD

The present invention is related to the electrochemical conversion of $CO_2$ and provides the use of Gas Diffusion Electrode (GDE) with an aprotic solvent in such conversion of gaseous $CO_2$ as well as an electrochemical cell for use in such conversion. The application and electrochemical cell as herein provided are particularly useful in the conversion of $CO_2$ into oxalate/oxalic acid.

BACKGROUND ART

The electrochemical reduction of $CO_2$ is an emerging technology to valorise captured $CO_2$ from waste streams or the atmosphere to produce value-added chemical or fuels. The electrochemical reductive dimerization of $CO_2$ to oxalate is however known since the late 1960s, when Sawyer and Haynes reduced $CO_2$ at Au and Hg electrodes in DMSO [1].

Mechanistic investigations by Kaiser et al. [2] suggest that the formation of oxalate proceeds through the dimerization of two radical $CO_2$ anions. The formation of this radical anion requires rather large potentials, which is why the $CO_2$ reduction in aqueous solution through this mechanism is not possible, as water reduction (Hydrogen Evolution Reaction, HER) or $CO_2$ reduction proceeding through protonated reaction intermediates, depending on the electrocatalyst, preferentially takes place at lower potentials. It was therefore postulated that the electrochemical $CO_2$ reduction to oxalate via a radical $CO_2$ anion can only be achieved in aprotic solvents. Although more recent publications suggest that the $CO_2$ reduction to oxalate is also possible through alternative reaction mechanisms [3]-[5], for example by using homogeneous metal complexes [3], [4], [6] as electrocatalysts. In general, homogeneous $CO_2$ reduction electrocatalysts exhibit limited turnover numbers and are more expensive for them to be applied commercially. Publications and patents on $CO_2$ reduction in aprotic solvents have focussed on the development of a selective electrocatalyst [7], solvent [2], [8]-[10] or an overall electrochemical process [11], [12], including the anode reaction and downstream processing [11].

Although overpotentials for the $CO_2$ reduction are higher in aprotic solvents, applying them helps avoiding the unwanted HER which is much harder to do in aqueous solvents, helping to increase the Faradaic Efficiency (FE) to the desired product. In addition, suitable aprotic solvents (such as DMSO, DMF, AN, PC) have a higher $CO_2$ solubility than water, allowing the reduction at higher current. While this is true, current densities using the present electrochemical processes with aprotic solvents reported in literature are still rather low (e.g. under 100 $mA \cdot cm^{-2}$) for commercial application.

For example in Skarlos (Texaco Patent filed 1973, [13]): Preferred cathode materials with high hydrogen evolution overvoltage such as (Cu, Pb amalgamated cathodes, Hg, Pb, stainless steel) are used in this set-up to prevent HER. A sacrificial AI electrode is used as anode. But as evident from the preferred operating conditions of this electrochemical cell, i.e. Voltage 5-20V, Cathodic potentials vs. SCE 1.8-2.3V, Current density 3-80 $mA \cdot cm^{-2}$, Temperature 20-60° C., fails to reach industrial relevant energy efficiencies and current densities.

In Twardowski, Cole (Liquid Light, Inc. Patent filed 2014, [14]) the cell also fails to reach industrial relevant current densities since the porous metal cathode materials selected from stainless steel, different Ni alloys, Mo, Co, W, are only compatible with dissolute $CO_2$ and cannot cope with a gaseous $CO_2$ supply.

Also the use of a homogenous catalyst, such as the heterocyclic amine catalyst, in Cole, Bocarsly (Liquid Light, Inc., Patent filed 2012, [6] to reduce the $CO_2$ to produce oxalic acid (reduction products) is not a solution in converting this electrochemical process into an industrial applicable process for $CO_2$ conversion. Homogeneous catalysts generally pose problems in regard to product/catalyst separation (if both is dissolved in the solution, extraction required) rendering them not immediately suitable in providing the most efficient industrial process.

Aims of the Invention

It is generally accepted that high current densities are required to reduce $CO_2$ efficiently and reduce the space-time-yield of an electrolyzer, e.g. around 100 $mA \cdot cm^{-2}$. To achieve this objective, it appears that one should be able to achieve a direct supply of gaseous $CO_2$ to the working electrode.

GDEs are 3D, porous electrodes. While they can be comprised of one catalyst layer, they are usually comprised of two layers, a catalyst layer (CL) and a gas diffusion layer (GDL). During the electrochemical reaction, a three-phase boundary is formed at the intersect between CL and GDL, consisting of the solid catalyst support and electrocatalyst (where the electrochemical reaction takes place), liquid electrolyte (closing the electrical circuit, transporting ions between electrodes) and gaseous $CO_2$ (dissolving as close as possible to the active site, reducing the diffusion path and enhancing the mass transfer).

In aqueous $CO_2$ reduction, the CL consists of a hydrophilic material, ensuring the flooding of the catalyst layer with electrolyte, and the GDL from a hydrophobic material prohibiting the electrolyte from filling the pores of the GDL and ensuring gas diffusion to the three-phase boundary inside the GDE. With the application of porous support materials (e.g. carbon black, activated carbon), the metal electrocatalyst can additionally be finely dispersed on the support material to ensure an increased catalyst surface area compared to the geometrical surface area of a flat electrode.

GDEs in aqueous $CO_2$ reduction were first proposed by Mahmood et al. in 1987 [15], [16]. Additionally, GDEs are applied commercially already, e.g. in chlorine-alkaline electrolysis, where oxygen depolarized cathode (ODC) GDEs (in oxygen reduction reaction) are used to overcome the low solubility of oxygen in alkaline solutions. With State-of-the-Art (SoA) GDEs in aqueous $CO_2$ reduction, current densities over 300 $mA \cdot cm^{-2}$ (compare Table below) are reported at standard conditions (room temperature, 1 atm pressure).

In aqueous $CO_2$ reduction, high FEs (>80%) to oxalate allowing an efficient and selective $CO_2$ reduction at industrial scale, as well as GDEs in general, have not been reported and as such the application of GDEs in aqueous solution does not resolve the desire of applying such electrochemical conversion of $CO_2$ in a high valued chemical such as oxalate on an industrial scale. To said respect the present investigation has shown that such results are achievable by applying a gas diffusion electrode (GDE) in the electrochemical conversion of $CO_2$ into oxalate in an aprotic solvent, preferably using a single chamber electrode.

As far as we know aqueous $CO_2$ reduction applying GDEs in the formation of oxalic acid has not yet been reported. Although oxalate/oxalic acid can be produced in aqueous solutions, the achievable FEs are not as high as reported in aprotic solvents due to aqueous $CO_2$ reduction products formed (e.g. such as CO, formate/formic acid, methane, methanol, ethylene, ethanol, mostly depending on the applied electrocatalyst) and HER taking place as side reactions. The application of aprotic solvents improves the FE to oxalate. Although the $CO_2$ solubility increases with the application of aprotic solvents, the $CO_2$ reduction at industrially relevant conditions remains a challenge in non-aqueous SoA applications. Fully submerged electrodes supplied with $CO_2$ through a previously saturated electrolyte can therefore only be operated at intermediate current densities (20-80 $mA \cdot cm^{-2}$, compare SoA patents above) or with high losses in current efficiency due to a drastic increase of the reactor voltage at high current densities (>100 $mA \cdot cm^{-2}$). There is a need for the design of an electrochemical cell enabling the electrochemical conversion of $CO_2$ in a high valued chemical, in particular oxalate with a high FE at high current densities.

TABLE

SoA publications in selected recent literature (2009-2019) in the aqueous $CO_2$ Reduction applying GDEs in semi-batch or continuous electrochemical reactors under standard conditions to products including formate/formic acid, carbon monoxide, methanol and ethylene.

| Catalyst/GDE support | Electrolyte | Potential $E_{wr}$/V | Current Density i/mA · $cm^{-2}$ | Faradaic Efficiency FE/— | Cell Setup | Publication Year |
|---|---|---|---|---|---|---|
| | | Product: Formate/Formic Acid | | | | |
| Sn/Carbon Black | 0.1M $KHCO_3$ at pH 10 | −1.57 V vs. SHE | 200 | 90% | Semi-batch | 2014 [17] |
| Sn/Carbon Black | 0.1M $KHCO_3$ at pH 10 | −1.57 V vs. SHE | 200 | 90% | Semi-batch | 2015 [18] |
| $SnO_2$/Carbon Black | 1M $KHCO_3$ at pH 10 | Not reported | 400 | 75% | Semi-batch | 2016 [19] |
| | 1M KOH | 2.5 V ($E_{Cell}$) | 130 | 80% | Continuous | |
| Sn/Carbon Paper | 0.5M $Na_2CO_3$ + 0.5M $Na_2SO_4$ | −1.6 V vs. Ag/AgCl | 388 | 80% | Semi-batch | 2017 [20] |
| | | Product: Carbon Monoxide | | | | |
| Ag/Carbon Nanotubes | 1M KOH | −0.75 V vs. RHE | 350 | >95% | Continuous | 2016 [21] |
| Ag/Carbon Paper | 3M KOH | −0.96 V vs. RHE | 343 | up to 100% | Continuous | 2016 [22] |
| Au/Carbon Nanotubes | 2M KOH | −1.45 V vs. Ag/AgCl | 120 | 90% | Continuous | 2018 [23] |
| Ag GDE (Covestro) | 1.5M $KHCO_3$ at pH 7 | 5 V ($E_{Cell}$) | 300 | 80% | Continuous | 2018 [24] |
| | | Product: Methanol | | | | |
| $Cu_2O$/Carbon Paper | 0.5M $KHCO_3$ | −1.39 V vs. Ag/AgCl | 10 | 55% | Continuous | 2016 [25] |
| $Cu_2O$, ZnO/Carbon Paper | | −1.16 V vs. Ag/AgCl | | 31% | | |
| | | Product: Ethylene | | | | |
| Cu/Graphite, Carbon NPs | 7M KOH | −0.55 V vs. RHE | 75-100 | 70% | Continuous | 2018 [26] |
| Cu/carbon paper | 1M KOH | −0.66 V vs. RHE | 653 | 62% | Continuous | 2018 [27] |

:

SUMMARY OF THE INVENTION

It has surprisingly been found that the foregoing problem of realizing high FEs with a high mass transfer in the electrochemical conversion of $CO_2$ could be resolved through the use of GDEs as cathode for the electrochemical conversion of $CO_2$ in an aprotic solvent. Using such configuration the mass transport of $CO_2$ to the active site at the cathode by supplying the $CO_2$ in gaseous form and dissolving it inside the GDE in the vicinity of the active electrocatalyst component supported on the catalyst support material is greatly enhanced. It provides a $CO_2$ reduction to oxalate/oxalic acid at industrial-relevant conditions, specifically related to the applicable current density (>100 mA·cm$^{-2}$) that has not been reported yet before.

A benefit of the present invention is that with an increased $CO_2$ supply to the active site, applying aprotic solvents (such as AN with higher solubility compared to water) and GDEs, the $CO_2$ reduction at high current densities can be realized even at reduced $CO_2$ concentrations in the feed gas. This has two advantages: Firstly, depending on the $CO_2$ waste stream source (e.g. flue gases with concentrations 10-15%, main impurity inert nitrogen $N_2$) a purification of the gas may not be necessary or may be confined to gas impurities which act as catalyst poisons or enable side reactions (non-inert gas impurities, e.g. oxygen). Secondly, a reduced $CO_2$ concentration in the vicinity of the electrode has been reported [17] to be beneficial in terms of the selectivity between the dimerization reaction to oxalate and the unwanted side disproportion reaction to CO and carbonate. Consequently, by skipping a cost- and energy-intensive purification step in a multi-step carbon capture and utilization process, the FE of the process could be improved further.

Further and as detailed hereinafter, by use of finely-dispersed metal electrocatalyst on cheap carbon support, the amount of metal catalyst applied can be reduced significantly, reducing the overall production cost of the electrode when compared to flat or porous, skeletal-type full-metal electrodes.

BRIEF DESCRIPTION OF THE FIGURES

Aspects of the invention will now be described in more detail with reference to the appended drawings, wherein same reference numerals illustrate same features and wherein.

DESCRIPTION OF THE INVENTION

The electrochemical reduction of $CO_2$ in general is an emerging technology as a means to utilize $CO_2$ from waste streams and electrical energy from renewable sources to produce value-added chemicals or fuels. The reaction at submerged electrodes in a liquid electrolyte at standard conditions is limited by the low solubility of $CO_2$ in the electrolyte. Consequently, the application of GDEs can alleviate this challenge by using gaseous $CO_2$ as a feedstock, the $CO_2$ is dissolved in the applied solvent inside the electrode (SoA aqueous $CO_2$ reduction). The application of aprotic solvents allows the $CO_2$ reduction to oxalate with high faradaic efficiencies. Aprotic solvents additionally increase the $CO_2$ solubility, allowing the reduction at reduced $CO_2$ concentrations ($CO_2$ reduction without purification of e.g. flue gas feedstock is possible). This further provides a more selective reduction [17]. The application of GDE for the electrochemical $CO_2$ reduction to oxalate has not been reported. For $CO_2$ reduction in aqueous solution, one important parameter towards commercialization of an electrochemical $CO_2$ reduction is a sufficient reaction rate (per geometrical electrode surface area), expressed by the current density i in mA·cm$^{-2}$. As the $CO_2$ solubility in aqueous solution is rather low, around 35 mmol/L, the bottleneck in electrochemical $CO_2$ reduction is often the mass transport limitation of $CO_2$ to the electrocatalytically active site. This is especially true for alkaline reaction media, which have often shown to be the preferred reaction conditions as a suppression of the HER enhances the selectivity (FE) to the desired $CO_2$ reduction product. In alkaline media the $CO_2$ concentration is even more reduced due to the formation of $HCO_3^-$. It is generally accepted that the commercialization of the aqueous electrochemical reduction of $CO_2$ to products requires the use of gas diffusion electrodes to reach commercially relevant current densities in the range from 100 to 500 and above $mA \cdot cm^{-2}$.

Figure 1:
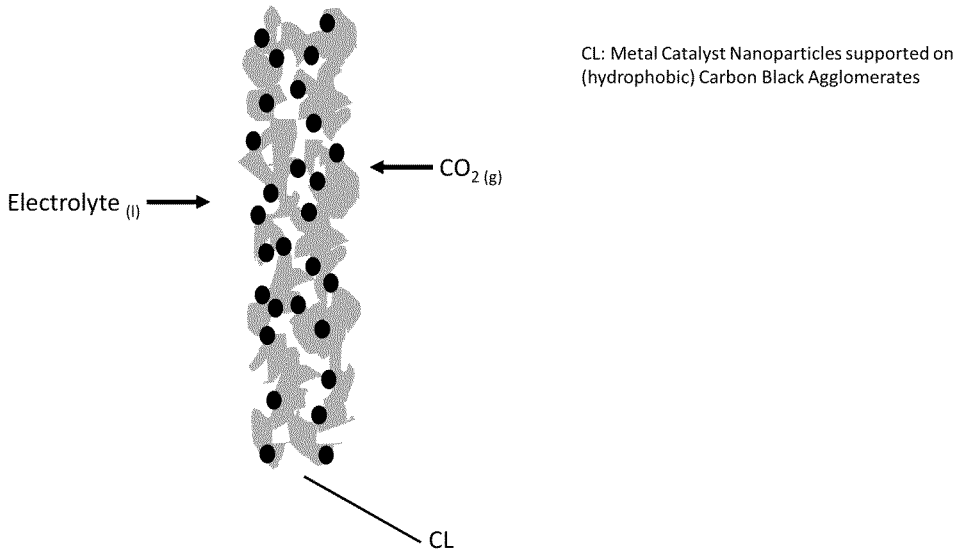
FIG. 1—Provides a schematic representation of a single layer GDE cathode for use in the methods and electrochemical cell according to the invention, comprising as a Catalyst Layer (CL) Metal Catalyst Nanoparticles supported on (hydrophobic) Carbon Black Agglomerates. The CL is exposed to the electrolyte and a supply of gaseous $CO_2$.
Figure 2:
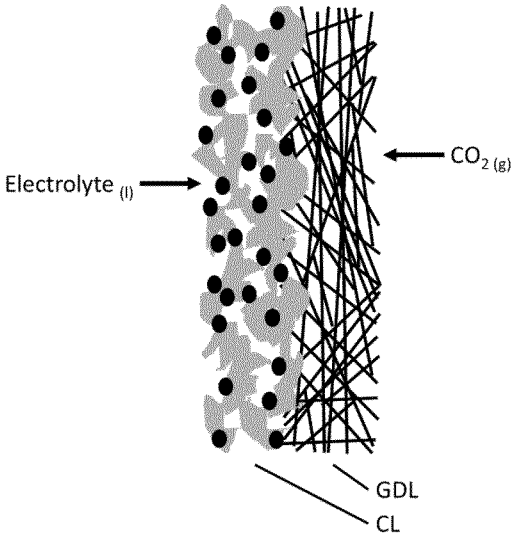
FIG. 2—Provides a schematic representation of a double layer GDE cathode for use in the methods and electrochemical cell according to the invention, comprising the CL as shown in FIG. 1, and a second Gas Diffusion Layer (GDL). The CL is exposed to the electrolyte and the GDL to a supply of gaseous $CO_2$.
Figure 3:
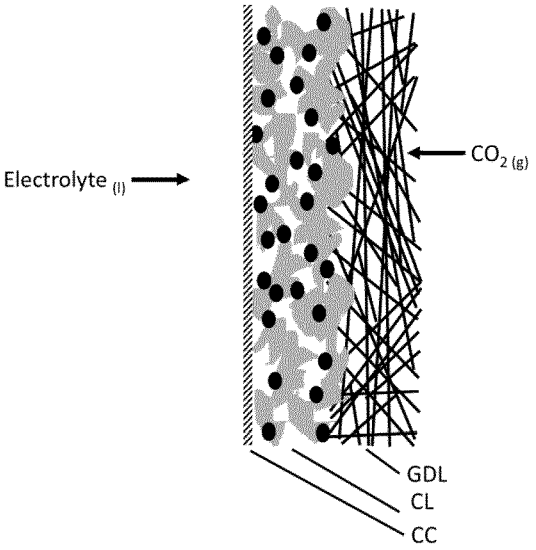
FIG. 3—Is a schematic representation of the double layer GDE as shown in FIG. 2, further comprising a Current Collector (CC) on the side exposed to the electrolyte.

Within the context of the present invention several configurations are conceivable:

- a single-layer-GDE (e.g. shown in FIG. 1): In this configuration the cathode is a GDE that consists of a single porous layer of a hydrophobic material (either the electrocatalyst itself or the electrocatalyst on a porous support (e.g. carbon)). In a particular embodiment the single porous layer is composed of an electrocatalyst on a porous support; more in particular metal catalyst nanoparticles supported on (hydrophobic) carbon black agglomerates.
- a double-layer-GDE (e.g. shown in FIGS. 2 and 3): In this configuration the GDE consists of two porous layers, which are fixed e.g. by calendaring them together. The first layer, the catalyst layer (CL) includes a finely dispersed electrocatalyst metal, e.g. on a porous carbon support. The second layer (Gas Diffusion Layer, GDL) consists of a hydrophobic porous material (e.g. made from PTFE mixed with a pore former such as $NH_4HCO_3$ ammonium bicarbonate). The described three-phase boundary forms between the intersection of CL (electrolyte filled) and the GDL (gas side). The GDE can further be equipped with a current collector (CC) (FIG. 3), an electrochemically inert, but highly conductive material (e.g. graphite, stainless steel mesh) providing a uniform current distribution along the surface of the GDE.

Where the GDE cathode comprises a gas diffusion layer consisting of a hydrophobic porous material, the current density can be enhanced by increasing the surface area of the electrode. Further, the supply of gaseous $CO_2$ to the backside of this layer of porous material allows for a more efficient mass transport of $CO_2$ to the active site. In contrast, it is believed that with a flat electrode the reachable current density is limited by the relatively slow charge transfer of electrons to $CO_2$. The GDEs comprising a layer of porous material according to an embodiment of the present invention, further provide the advantage of allowing to be configured between charge-transfer and mass-transport controlled regime. This maximizes the achievable current densities at low local $CO_2$ concentrations, favoring the formation of oxalate and increasing the selectivity to the desired product. Maximizing the achievable current densities at low local $CO_2$ concentrations is of great importance for the application of the electrochemical cells according to the present invention in the reduction of $CO_2$ in diluted $CO_2$ waste gas streams (e.g. flue gases, waste gas streams from a biorefinery) without or with a less extensive gas washing and purification process step, reducing overall process costs. With a flat electrode, which therefore does not comprise said layer of porous material, the reachable current density is limited by the relatively slow charge transfer of electrons to $CO_2$ therefore providing a worse solution to the reduction of $CO_2$ at low concentrations. n a particular embodiment the GDEs used in the context of the present invention comprise a CL wherein the electrocatalyst is fixed on a porous support, e.g. by physically mixing with a binder (e.g. PTFE), precipitation and/or electrodeposition. More in particular the CL comprises metal catalyst nanoparticles supported on (hydrophobic) carbon black agglomerates.

Figure 4:
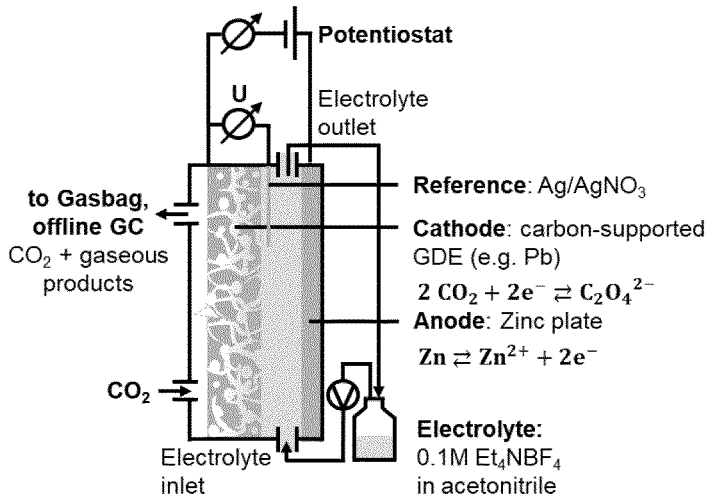
FIG. 4—Provides a schematic representation of a single chamber electrochemical cell for use in the electrochemical conversion of $CO_2$ in an aprotic solvent using a GDE as cathode.

A schematic representation of an electrochemical cell for the electrochemical conversion of $CO_2$ in an aprotic solvent using a GDE as cathode is shown in FIG. 4. $CO_2$ gas is continuously supplied to the GDL side of the GDE. The electrochemical cell can either be operated in a continuous mode, meaning both $CO_2$ and the electrolyte in the cathode chamber (catholyte) are continuously supplied, liquid (e.g. oxalic acid) or precipitated (e.g. zinc oxalate) products are taken out of the reactor with the catholyte stream. This catholyte can also be recycled, directly or after the reaction products have been separated from the electrolyte. Another mode of operation is a semi-batch mode, where, while the $CO_2$ is continuously supplied through the GDL of the gas diffusion electrode, the catholyte is kept in the cathode chamber in a batch-operated mode. The cell is operated by applying an external voltage (supplied by an potentiostat) between the two electrodes, at the cathode $CO_2$ is reduced to oxalate (CO and carbonate $CO_3^{2-}$, formate and/or hydrogen may be produced as side products).

The Anode reaction can be a sacrificial anode (e.g. zinc, aluminium), producing zinc oxalate or aluminium oxalate as end products (hardly soluble, precipitates in solution). Alternatively, other established oxidation reactions such as oxygen evolution reaction OER, hydrogen oxidation reaction (HOR, possibly also at GDE or in a membrane) can be applied, producing oxalic acid as the end product. The oxidation and reduction reaction at respectively the anode and cathode can either be performed in a single chamber (such as shown in FIG. 4) where the anode electrolyte (anolyte)—and cathode electrolyte (catholyte) are the same, or can be separated by a conducting membrane.

As mentioned herein before, one of the characteristics of the method according to the invention is the use of an aprotic solvent at the cathode reaction. Catholytes could for example be selected from 0.1 M tetraalkylammonium salts as cations, e.g. tetraethylammonium $NEt_4^+$ or tetrabutylammonium $NBu_4^+$ and e.g. tetrafluoroborates $BF_4^-$, perchlorates $ClO_4^+$ or hexafluorophosphates $PF_6^-$ as anions in aprotic solvents (e.g. AN, DMF, PC, DMSO). Aprotic meaning no acidic hydrogen bond such as O—H, N—H. In a particular embodiment the catholyte used in the method according to the invention consists of a tetraalkylammonium tetrafluoroborate salt as supporting electrolyte, e.g. tetraethylammonium tetrafluoroborate $NEt_4BF_4$ or tetrabutylammonium tetrafluoroborate $NBu_4BF_4$ in an aprotic solvent (e.g. AN, DMF, PC, DMSO). In a more particular embodiment 0.1 M tetraethylammonium tetrafluoroborate $NEt_4BF_4$ in AN.

If a conducting membrane is applied in a multi-chamber reactor, the anolyte can differ from the catholyte, e.g. an aqueous electrolyte for the OER (water oxidation) can be applied. Established electrolytes are e.g. aqueous solutions of alkali metal (bi-)carbonates, (hydrogen-)sulfates, (bihydrogen-, hydrogen-)phosphates or halide salts. As shown below, the best results are however achieved in a single chamber reaction as it is difficult to fully prevent water cross-over from the anode to the cathode chamber, and it has been found that the presence of water at the cathode side has a negative effect on the $CO_2$ to the FE to oxalate at the cathode.

The cathode catalyst layer as used herein preferably comprise metal or metal oxide catalysts selected from the group consisting of Pb, Ti, Fe, Mo or combinations thereof; more in particular metal nanoparticles selected from Pb, Ti, Fe, Mo or combinations thereof. In one embodiment the metal catalysts are selected from the group consisting of Pb, Fe, Mo or combinations thereof; more in particular metal nanoparticles selected from Pb, Fe, Mo or combinations thereof. In another embodiment the metal catalysts are selected from the group consisting of Pb, Mo or combinations thereof; more in particular metal nanoparticles selected from Pb, Mo or combinations thereof. In a preferred embodiment the cathode catalyst layer comprises Pb as metal catalyst, in particular Pb nanoparticles.

RESULTS

Metal Catalyst Screening and Effect of $c(H_2O)$ on Catalyst Performance

Figure 5:
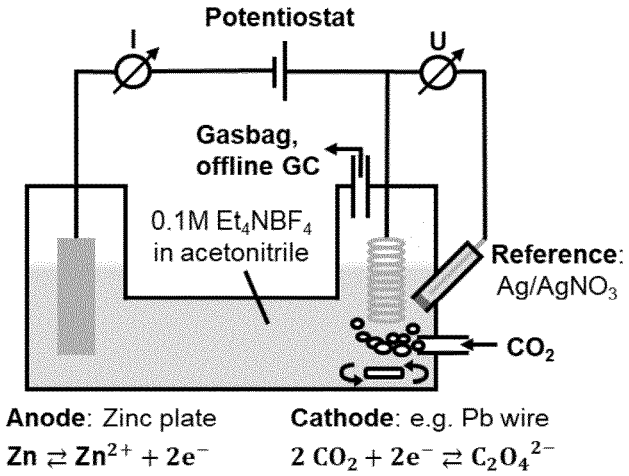
FIG. 5—Shows a schematic representation of an electrochemical setup used to test the conversion of $CO_2$ to oxalate in an aprotic solvent using different metal catalysts and with increasing concentrations of water in the electrolyte solution.

FIG. 5 shows a schematic representation of an electrochemical setup used to test the conversion of $CO_2$ to oxalate in an aprotic solvent using different metal catalysts and with increasing concentrations of water in the electrolyte solution. The cell is a H-type cell with a electrolyte volume of $V_E$=20 mL of 0.1 M tetraethylammonium tetrafluoroborate ($Et_4NBF_4$) in AN with a $Ag/AgNO_3$ reference electrode. The applied AN was dried over 3∈ molecular sieves for at least 48 h, the tetraethylammonium tetrafluoroborate was recrystallized from methanol and dried under vacuum. In experiments with increased $c(H_2O)$, demineralized water was added pre-experiment.

Pb, Ti, Fe, and Mo wires with a diameter of ø=0.5 mm and a length of l=25 cm were employed as working electrodes, while a Zn wire with a diameter of ø=0.5 mm and a length of l=50 cm was used as the counter electrode. The measurements were performed in a one compartment setup, without the use of a membrane. After galvanostatic measurements, the AN was evaporated and the solid residue of $Et_4NBF_4$, $ZnC_2O_4$ and $Zn(HCOO)_2$ is picked up in 1 M $H_2SO_4$ and the produced oxalate and formate is determined via HPLC. The water concentration of the employed electrolyte was assessed using Karl-Fischer Titration.

Linear sweep voltammetry (LSV) experiments were employed to investigate the activity of the employed metal catalysts. Galvanostatic measurements were utilized to assess the product distribution in aprotic conditions and with added water impurities.

Figure 6:
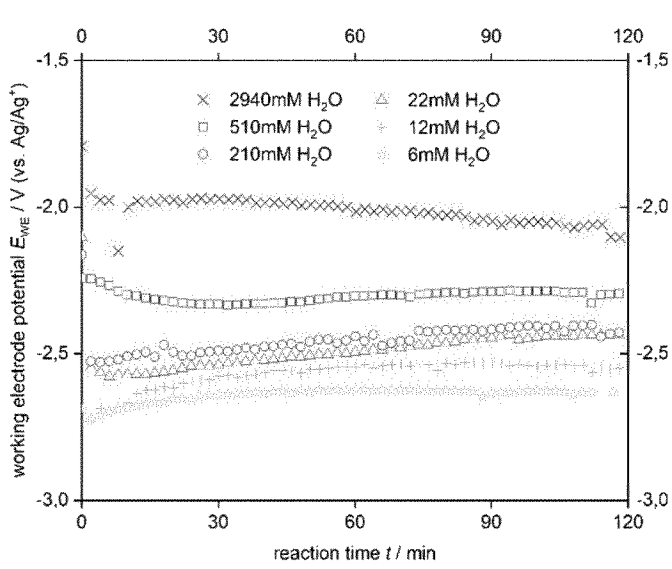
FIG. 6—Linear sweep voltammetry (LSV) experiment (left, dV·dt$^{-1}$=5 mV·s$^{-1}$) and galvanostatic experiments (right, I=10 mA)■-Employing a Mo wire Working Electrode (WE), continuously supplied $CO_2$ ($\dot{V}$=10 mL·min$^{-1}$) for various concentrations of water c($H_2O$). Left: Measured current I/mA plotted over WE potential $E_{WE}$/V. $N_2$ purged reactor (red plot) as blank experiment. Right: WE potential $E_{WE}$/V plotted over reaction time t/min.
Figure 6:
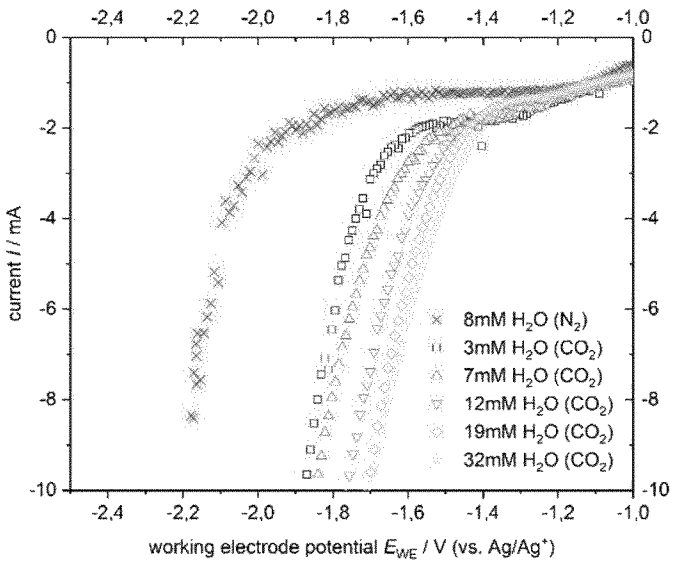

FIG. 6 shows that the onset potential is shifted towards less negative potentials with increasing $c(H_2O)$, indicating an increased activity of the metal catalyst at higher water concentrations. This effect is related to an increasingly predominant side reaction (such as HER, formate production) with increasing $c(H_2O)$.

Figure 7:
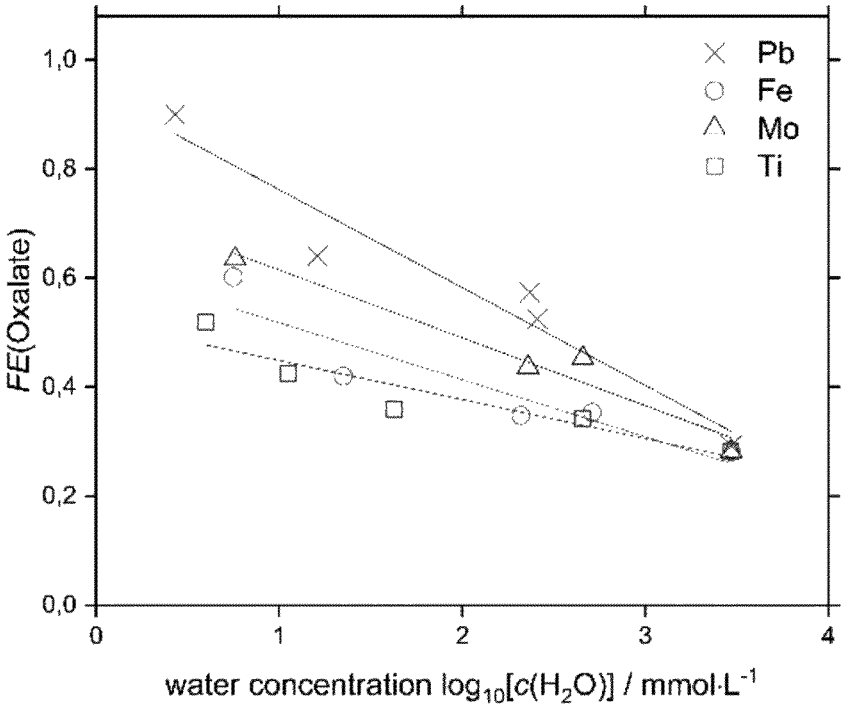
FIG. 7—Faradaic Efficiency (FE) to Oxalate (right) for the respective experiments, at various water concentrations in solution.

To investigate the shift in potential with increasing water concentrations, galvanostatic measurements were performed, collecting the dissolved and precipitated reaction products, quantifying them using HPLC. FIG. 7 shows the FE(Oxalate) for the four different metal catalysts plotted over $\log(c(H_2O))$. The results show that indeed a decrease of FE(Oxalate) towards other reaction products is the cause for the increased activity of the applied catalyst metal wires at higher $c(H_2O)$. For the Pb wire, the decrease in FE(Oxalate) corresponded to an increase in c(Formate). For Mo, Fe and Ti, no formate was detected. These results can be explained with the activities of the respective metals in aqueous solution. As stated in the introduction, $CO_2$ reduction catalysts are categorized into groups including CO forming catalysts, hydrocarbon forming catalysts, formate forming catalysts and catalysts which show no activity towards $CO_2$ reduction. Pb is part of the group forming formate in aqueous solutions, explaining the shift from oxalate towards formate with an increasing $c(H_2O)$ in the electrolyte. In contrast, Mo, Fe and Ti are metal catalysts which show no activity towards $CO_2$ reduction in aqueous solution, as the overpotential required for the HER is too low. The observed reaction in water is therefore the formation of $H_2$ via water reduction.

These experiments accordingly show that Mo and Fe show intermediate FE(Oxalate), Ti shows the lowest and Pb the highest FE(Oxalate) at low $c(H_2O)$. The present results clearly show that the activity of Mo, Fe and Ti metal catalysts towards $CO_2$ reduction drops with increasing $c(H_2O)$ in the electrolyte.

Pb Metal Catalyst Comparison of a Non-Porous Electrode With a Two-Layered GDE Electrode Having identified Pb as the metal catalyst with the highest activity towards $CO_2$ reduction in an aprotic environment two types of electrodes were prepared to validate the cell setup and to compare the applicability in an industrial electrochemical conversion of $CO_2$.

NPPb100: A non-porous Pb/PTFE electrode was prepared by mixing Pb powder with PTFE powder in a knife mill with a mass ratio of Pb:PTFE of 94:6. The mixed powder was consequently pressed to a cake at a pressure of 5 bar. The cake was then rolled down in 0.05 mm steps using a roll down to a final thickness of 0.5 mm.

Pb5 GDE: A porous, two-layered GDE was prepared based on the production procedures of the patented VITO CORE® GDEs. The gas diffusion layer (GDL) was prepared by sieving $NH_4HCO_3$ (pore former) to achieve a uniform particle size. Consequently, $NH_4HCO_3$ and PTFE are pressed to form flakes in rolling cylinders filled with metal balls of different weight. The flakes are mixed and cut with graphite in a knife mill afterwards to achieve a mass ratio of $NH_4HCO_3$:PTFE:Graphite of 66:29:5. The mix is pressed to a cake with a pressure of 5 bar and the cake is rolled down to a thickness of 1 mm. The catalyst layer was produced by mixing Norit Activated Carbon, PTFE and Pb metal powder in a knife mill in a ratio of Norit:PTFE:Pb of 75:20:5. Likewise to the GDL, the mixed powder was pressed to a cake and rolled down to a size of 1 mm. Finally, GDL and catalyst layer were rolled down together to a final thickness of 0.5 mm. The prepared electrode was kept at 70° C. overnight.

Full-Pb-GDE: A porous, two-layered GDE was prepared based on the production procedures of the patented VITO CORE® GDEs. The gas diffusion layer (GDL) was prepared by sieving $NH_4HCO_3$ (pore former) to achieve a uniform particle size. Consequently, $NH_4HCO_3$ and PTFE are pressed to form flakes in rolling cylinders filled with metal balls of different weight. The flakes are mixed and cut in a knife mill afterwards to achieve a mass ratio of $NH_4HCO_3$:PTFE of 3:7. The mix is pressed to a cake with a pressure of 5 bar and the cake is rolled down to a thickness of 0.5 mm. The catalyst layer was produced by mixing $NH_4HCO_3$, PTFE and Pb metal powder in a knife mill in a ratio of $NH_4HCO_3$:PTFE:Pb of 36:18:195. Likewise to the GDL, the mixed powder was pressed to a cake and rolled down to a size of 0,5 mm. Finally, GDL and catalyst layer were rolled down together to a final thickness of 0.6 mm. The prepared electrode was kept at 70° C. overnight.

Figure 8:
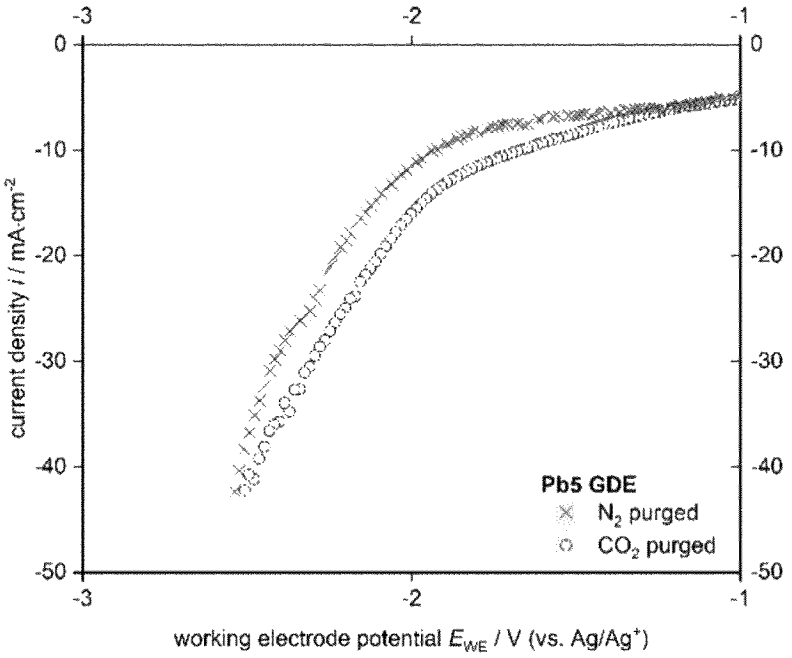
FIG. 8—LSV (dV·dt$^{-1}$=5 mV·s$^{-1}$) experiments employed in microflow cell setup (see FIG. 4). Measured current density i/mA·cm$^{-2}$ plotted over WE potential $E_{WE}$/V. $N_2$ purged reactor (red plot) as blank experiment. Left: Non-porous Pb/PTFE electrode. Right: two-layer GDE with 5 wt. % Pb catalyst layer.
Figure 8:
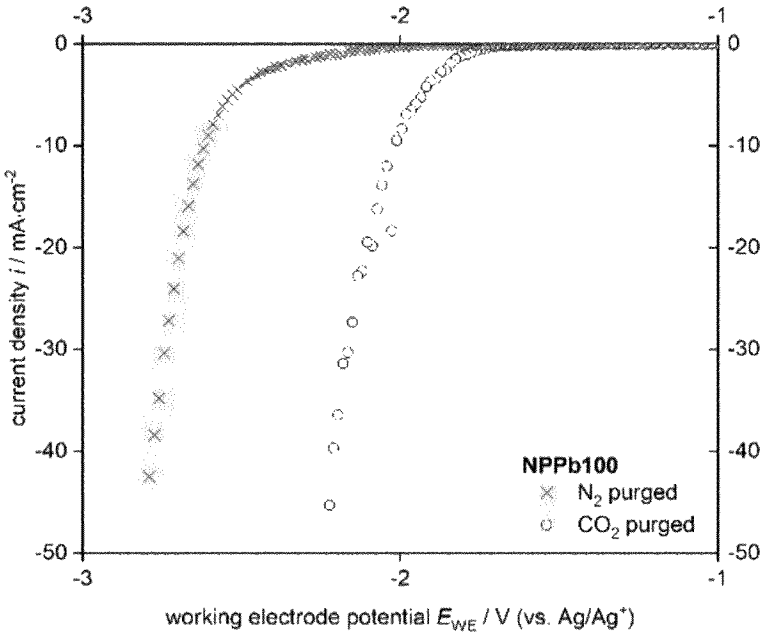

FIG. 8 shows the first LSV experiments performed in the microflow cell. Both LSVs show an enhanced activity comparing $CO_2$ to $N_2$, which is related to the electrochemical reduction of $CO_2$. A distinct reduction peak for $CO_2$ is visible for both electrodes at −1.8V vs. Ref. All in all, a drastic increase in measured current densities is achieved compared to experiments employing a metal wire. This can be explained by the optimized geometry of both the electrode as well as the applied electrochemical cell, reducing the overall required cell voltage. A difference in the slope of the increasing current density between NPPb100 and Pb5 GDE is visible. A steeper slope for the NPPb100 indicates that an increased Pb surface area is improving the reaction rate of the charge transfer controlled reaction. A regime where the reaction becomes mass transport limited is not reached yet, the compliance voltage limit of the potentiostat is reached for both electrodes at around a current density of $i=40\ mA \cdot cm^{-2}$, corresponding to a current of I=400 mA. The shifted baseline for the Pb5 GDE (FIG. 8, right) is related to the applied carbon material, as the current flow below −1.8 V (for both $CO_2$ and $N_2$ purged experiments) is caused by capacitive currents. Preliminary experiments have shown that the measured current density strongly depends on the applied scan rate during the LSV experiment and is reduced with reduced scan rates.

Figure 9:
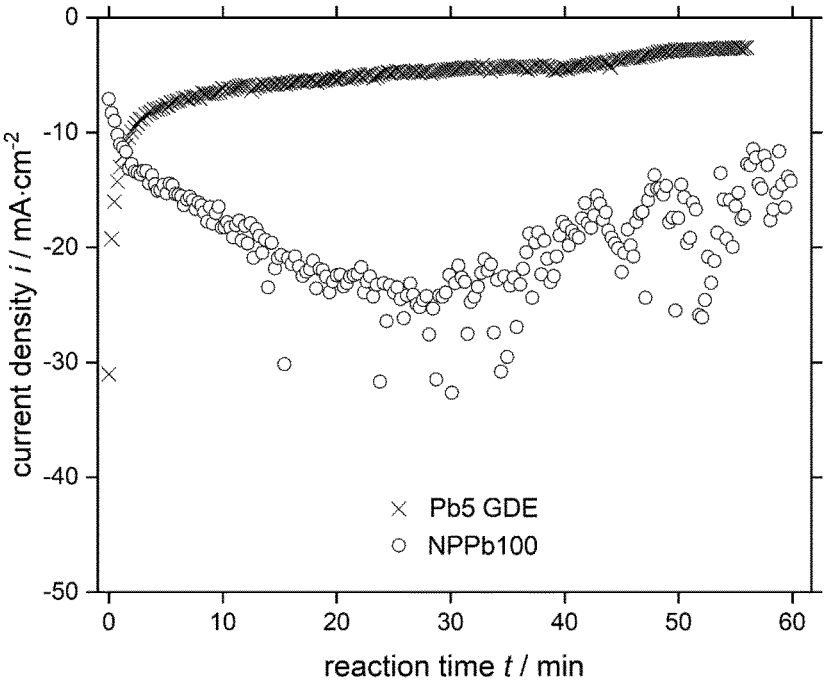
FIG. 9—Potentiostatic experiments at an applied working electrode potential $E_{WE}$=−2 V. Measured current density i/mA·cm$^{-2}$ plotted over the reaction time t/min. Results of non-porous Pb/PTFE electrode (circle) compared to two-layer GDE with 5 wt. % Pb catalyst layer (cross).

Remarkable however is how the performance of the GDE compares to the non-porous electrode. Compared to the later the GDE comprises 20 times less of the metal catalysts still shows only a slightly lower current density. In addition, when looking at potentiostatic experiments over time (see FIG. 9) current densities in the GDE or stable compared to the fluctuations in the non-porous electrode. This could be related to the reduced current density, and therefore gas evolution, or due to the hydrophobic nature of the GDL.

Figure 10:
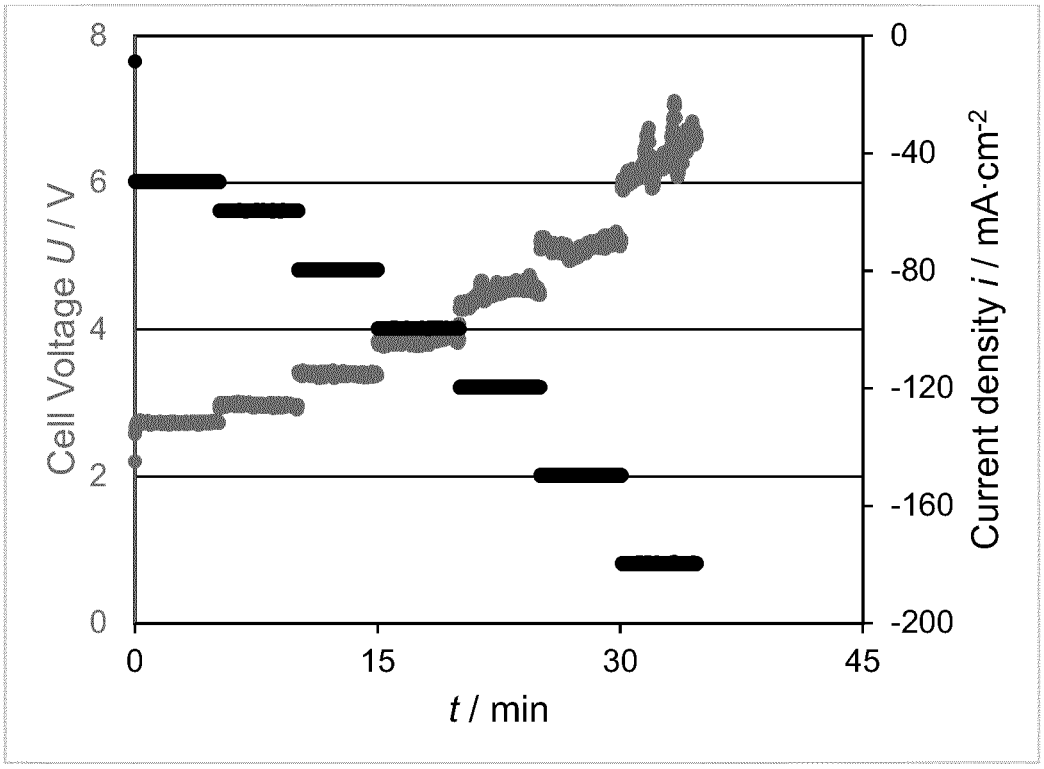
FIG. 10—Galvanostatic experiments in a two-electrode configuration employing a porous lead electrode Full-Pb. Measured cell voltage U/V (left y axis) and applied current density i/mA·cm$^{-2}$ (right y axis) plotted over the reaction time t/min.
Figure 11:
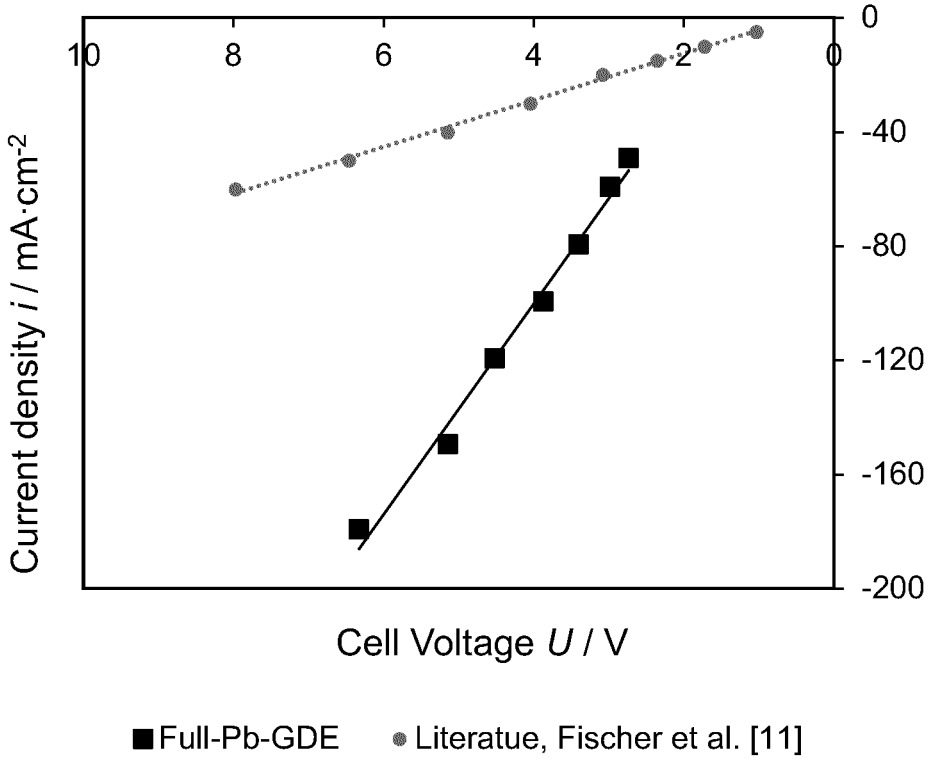
FIG. 11—Comparison of results displayed in FIG. 10 with highest reported literature value in terms of achieved current density without the use of a GDE in $CO_2$ to oxalate reduction. Results of galvanostatic experiments in a two-electrode configuration employing a porous Pb electrode Full-Pb. Applied current density i/mA·cm$^{-2}$ plotted over the measured cell voltage U/V.

FIG. 10 indicates the achievable current densities when applying a GDE. FIG. 10 shows the corresponding cell voltages of a two electrode configuration applying a Full-Pb-GDE. It shows that current densities, depicted in the graph in in black, of above $100\ mA \cdot cm^{-2}$ can be achieved, which has not been reported in literature. In FIG. 10 the cell voltages are instead depicted in grey. FIG. 11 shows the comparison of these results to the highest current densities reported in literature for $CO_2$ to oxalate electroreduction under ambient conditions [11]. The results indicate that higher current densities can be achieved at lower cell voltages compared to literature. At a cell voltage of 4 V, a current density of $100\ mA \cdot cm^{-2}$ could be reached, an increase by a factor 3 compared to the results reported in literature.

In order to achieve a stable $CO_2$ reduction at high current densities, it will be imperative to optimize the hydrophobicity of the GDL even further, not only to provide a sufficient $CO_2$ supply to the active site, but also to prohibit evolving gas from exiting the reactor through the catalyst layer and the electrolyte.

Where the current experiments successfully show the application and design of a GDE cathode in the electrochemical conversion of $CO_2$, experiments to further improve the GDE in terms of long-term stability, FE, CE and concerning the whole electrochemical system (solvent, anode reaction, supporting electrolyte) are currently being conducted This technology can be valorized in the electrochemical reduction of $CO_2$, in particular to produce oxalate/oxalic acid in a sustainable manner (utilizing waste $CO_2$) and has the potential to be cheaper compared to existing technologies with main cost factors being the capital cost of the electrode, the electrode lifetime/stability and most importantly the electricity tariff. Oxalic acid, either as a bulk chemical or as an intermediate to produce other value added chemicals (e.g. through further reduction to produce ethylene glycol, which is applied as a precursor to produce polymers such as PET. The total PET demand for plastics in Europe (EU28+NO/CH) was 4 Mt in 2018 [18])

Compared to existing technology the methods and devices used in the present invention show the following distinguishing characteristics.

a) Thermal $CO_2$ Reduction/Production of Oxalic Acid in General
   - Production under ambient conditions without pressure/increased temperature
   - No additional oxidizing agent/co-catalyst (such as nitric acid) required b) Electrochemical Production of Oxalic Acid (using conventional electrodes, through the dimerization through formate)
   - Application of GDE for increased mass transport properties in solution, allows application at reduced $CO_2$ concentrations, and accordingly provides improved $CO_2$ conversion.
   - High selectivity with the application of aprotic solvent (only gaseous side product: CO), as opposed to aqueous $CO_2$ reduction.
   - $CO_2$ Reduction to oxalate can be done in a one-step process as opposed to two-step process through formate with expensive downstream processing of diluted formate/formic acid solutions in between (e.g. through rectification of solution).

The aforementioned functional characteristics of the present invention are based on the application of an electrochemical cell of which the technical characteristics can be summarized in the following numbered embodiments or any combinations thereof.

Embodiment 1—Use of an electrochemical cell for the electrochemical conversion of $CO_2$ characterized in that said electrochemical cell comprises a Gas Diffusion Electrode (GDE) as cathode and that the $CO_2$ is supplied in gaseous form to the cathode where it is dissolved in a catholyte ion solution comprising an aprotic solvent.

Embodiment 2—Use according to embodiment 1, wherein the electrochemical cell is operated in a continuous mode wherein the catholyte ion solution and the $CO_2$ are continuously supplied to the cathode chamber.

Embodiment 3—Use according to embodiment 1, wherein the electrochemical cell is operated in a semi-batch mode, wherein the $CO_2$ is continuously supplied to the cathode chamber and the catholyte ion solution is kept in the cathode chamber in a batch-operated mode.

Embodiment 4—Use according to any one of the previous embodiments wherein the supporting electrolyte in the catholyte ion solution is selected from the group consisting of tetraalkylammonium salts of tetrafluoroborates, perchlorates or hexafluorophosphates as supporting electrolytes in aprotic solvents; in particular tetraalkylammonium salts such as tetraethylammonium or tetrabutylammonium. It would be clear to the skilled in the art that the supporting electrolyte salt comprises at least one cation and one anion.

Embodiment 5—Use according to any one of the previous embodiments wherein the aprotic solvent is selected from the group consisting of Acetonitrile, Dimethyl Sulfoxide, Dimethylformamide, and Propylene Carbonate; in particular Acetonitrile.

Embodiment 6—Use according to any one of the previous embodiments wherein the anode in the electrochemical cell is a sacrificial anode, such as a sacrificial Zinc or Aluminium anode.

Embodiment 7—Use according to any one of the previous embodiments wherein the electrochemical cell is a single chamber electrochemical cell.

Embodiment 8—Use according to embodiment 1 wherein the GDE comprises a metal or metal oxide catalyst; in particular metal or metal oxide catalyst nanoparticles.

Embodiment 9—Use according to embodiment 8, wherein the metal or metal oxide catalysts are selected from Pb, Ti, Fe, Mo or combinations thereof.

Embodiment 10—Use according to embodiments 8 or 9, wherein the metal or metal oxide catalyst is provided on a porous support; in particular finely dispersed as nanoparticles on a porous support.

Embodiment 11—Use according to any one of the previous embodiments wherein the GDE cathode is a single-layer-GDE cathode.

Embodiment 12—Use according to any one of the previous embodiments wherein the GDE cathode is double-layer-GDE cathode.

Embodiment 13—Use according to embodiment 12, wherein the double-layer-GDE cathode comprises a catalyst layer comprising the metal or metal oxide catalyst according to any one of claims 8 to 10; and a gas diffusion layer consisting of a hydrophobic porous material; in particular polytetrafluoroethylene (PTFE) mixed with a pore former such as ammonium bicarbonate.

Embodiment 14—Use according to any one of embodiments 8 to 13, wherein the GDE comprises a current collector, in particular a current collector consisting of a layer of an electrochemically inert but highly conductive material such as a graphite or stainless steel mesh.

Embodiment 15—Use according to embodiment 10, wherein the metal or metal oxide catalyst is provided on a support of hydrophobic carbon black agglomerates.

Further to the foregoing embodiments related to the use of a GDE Cathode with an aprotic solvent in the electrochemical conversion of $CO_2$, it is also an object of the present invention to provide GDE's for use in such electrochemical cell and the cell thus obtainable as summarized in the following numbered embodiments or combinations thereof.

Embodiment 16—An electrochemical cell for use in the electrochemical conversion of $CO_2$, said electrochemical cell comprising;

a. GDE cathode, b. a gaseous $CO_2$ inlet to the GDE cathode, and c. a supporting electrolyte in an aprotic solvent.

Embodiment 17—The electrochemical cell according to embodiment 16, further comprising a sacrificial anode, such as a sacrificial Zinc or Aluminium anode.

Embodiment 18—The electrochemical cell according to claim 16, further comprising a catholyte inlet and outlet.

Embodiment 19—The electrochemical cell according to embodiments 16 to 18, wherein said cell is a single-chamber electrochemical cell.

Embodiment 20—The electrochemical cell according to embodiment 16, wherein the supporting electrolyte is selected from the group consisting of tetraalkylammonium salts of tetrafluoroborates, perchlorates or hexafluorophosphates as cation and anion, respectively; in particular tetraalkylammonium salts such as tetraethylammonium or tetrabutylammonium.

Embodiment 21—The electrochemical cell according to embodiment 16, wherein the aprotic solvent is selected from the group consisting of Acetonitrile, Dimethyl Sulfoxide, Dimethylformamide, and Propylene Carbonate; in particular Acetonitrile.

Embodiment 22—The electrochemical cell according to embodiment 16, wherein the GDE cathode comprises a metal or metal oxide catalyst; in particular metal or metal oxide catalyst nanoparticles.

Embodiment 23—The electrochemical cell according to embodiment 22, wherein the metal or metal oxide catalysts are selected from Pb, Ti, Fe, Mo or combinations thereof.

Embodiment 24—The electrochemical cell according to embodiment 22, wherein the metal or metal oxide catalyst is provided on a porous support; in particular finely dispersed as nanoparticles on a porous support.

Embodiment 25—The electrochemical cell according to any one of embodiments 16 to 24, wherein the GDE cathode is a single-layer-GDE cathode.

Embodiment 26—The electrochemical cell according to any one of embodiments 16 to 24, wherein the GDE cathode is double-layer-GDE cathode.

Embodiment 27—The electrochemical cell according to embodiment 26, wherein, wherein the double-layer-GDE cathode comprises a catalyst layer comprising the metal or metal oxide catalyst according to any one of embodiments 22 to 24; and a gas diffusion layer consisting of a hydrophobic porous material; in particular polytetrafluoroethylene (PTFE) mixed with a pore former such as ammonium bicarbonate.

Embodiment 28—The electrochemical cell according to any one of embodiments 16 to 24, wherein the GDE cathode comprises a current collector, in particular a current collector consisting of a layer of an electrochemically inert but highly conductive material such as a graphite or stainless steel mesh.

Embodiment 29—The electrochemical cell according to embodiment 24, wherein the metal or metal oxide catalyst is provided on a support of hydrophobic carbon black agglomerates.

References

[1] L. V Haynes and D. T. Sawyer, "Electrochemistry of Carbon Dioxide in Dimethyl Sulfoxide at Gold and Mercury Electrodes," *Anal. Chem.*, vol. 39, no. 3, pp. 332-338,1967.

[2] V. U. Kaiser and E. Heitz, "Zum Mechanismus der elektrochemischen Dimerisierung von CO2 zur Oxalsaeure," *Berichte der Bunsen-Gesellschaft*, vol. 77, no. 10/11, pp. 818-823,1973.

[3] M. Rudolph, S. Dautz, and E. G. Jager, "Macrocyclic [N4/2−] coordinated nickel complexes as catalysts for the formation of oxalate by electrochemical reduction of carbon dioxide," *J. Am. Chem. Soc.*, vol. 122, no. 44, pp. 10821-10830,2000.

[4] R. Angamuthu, P. Byers, M. Lutz, A. L. Spek, and E. Bouwman, "Electrocatalytic CO2 Conversion to Oxalate by a Copper Complex," *Science*, vol. 327, no. 5963, pp. 313-315,2010.

[5] A. R. Paris and A. B. Bocarsly, "High-Efficiency Conversion of CO2 to Oxalate in Water Is Possible Using a Cr-Ga Oxide Electrocatalyst," *ACS Catal.*, vol. 9, no. 3, pp. 2324-2333,2019.

[6] E. B. Cole, K. Teamey, A. B. Bocarsly, and S. Narayanappa, "REDUCTION OF CARBON DIOXIDE TO CARBOXYLIC ACIDS, GLYCOLS, AND CARBOXYLATES," 2013.

[7] S. Ikeda, T. Takagi, and K. Ito, "Selective formation of formic acid, oxalic acid, and carbon monoxide by electrochemical reduction of carbon dioxide," *Bull. Chem. Soc. Jpn.*, vol. 60. pp. 2517-2522, 1987.

[8] Y. Tomita, S. Teruya, O. Koga, and Y. Hori, "Electrochemical Reduction of Carbon Dioxide at a Platinum Electrode in Acetonitrile-Water Mixtures," *J. Electrochem. Soc.*, vol. 147, no. 11, pp. 4164-4167,2000.

[9] T. C. Berto, L. Zhang, R. J. Hamers, and J. F. Berry, "Electrolyte dependence of CO2 electroreduction: Tetraalkylammonium ions are not electrocatalysts," *ACS Catal.*, vol. 5, no. 2, pp. 703-707,2015.

[10] J. Shi et al., "Electrochemical reduction of CO2 into CO in tetrabutylammonium perchlorate/propylene carbonate: Water effects and mechanism," *Electrochim. Acta*, vol. 240, pp. 114-121,2017.

[11] J. Fischer, T. Lehmann, and E. Heitz, "The production of oxalic acid from CO2 and H2O," *J. Appl. Electrochem.*, vol. 11, pp. 743-750,1981.

[12] F. Goodridge and G. Presland, "The electrolytic reduction of carbon dioxide and monoxide for the production of carboxylic acids," *J. Appl. Electrochem.*, vol. 14, no. 6, pp. 791-796,1984.

[13] L. Skarlos, "Preparation of Oxalic Acid," 1973.

[14] E. B. Cole et al., "Method and System for production of oxalic acid and oxalic acid reduction products," 2016.

[15] M. N. Mahmood, D. Masheder, and C. J. Harty, "Use of gas-diffusion electrodes for high-rate electrochemical reduction of carbon dioxide. I. Reduction at lead , indium- and tin-impregnated electrodes," *J. Appl. Electrochem.*, vol. 17, pp. 1159-1170,1987.

[16] M. N. Mahmood, D. Masheder, and C. J. Harty, "Use of gas-diffusion electrodes for high-rate electrochemical reduction of carbon dioxide. II. Reduction at metal phthalocyanine-impregnated electrodes," *J. Appl. Electrochem.*, vol. 17, pp. 1223-1227,1987.

[17] A. Gennaro, I. Bhugunb, and J. Saveant, "Mechanism of the electrochemical reduction of carbon dioxide at inert electrodes in media of low proton availability," *J. Chem. Soc., Faraday Trans.*, vol. 92, no. 20, pp. 3963-3968,1996.

[18] "Plastics—the Facts 2019," 2019.

The invention claimed is:

1. An electrochemical cell for the electrochemical conversion of $CO_2$, said electrochemical cell comprising:

(a) a gas diffusion electrode as a cathode;

(b) a gaseous $CO_2$ inlet to the gas diffusion electrode;

(c) a supporting electrolyte in an aprotic solvent as a catholyte; and (d) an anode, wherein the electrochemical cell is a single-chamber electrochemical cell.

2. The electrochemical cell according to claim 1, wherein the supporting electrolyte is selected from the group consisting of tetraalkylammonium salts of tetrafluoroborates, tetraalkylammonium salts of perchlorates, and tetraalkylammonium salts of hexafluorophosphates, the supporting electrolyte being dissolved in an aprotic solvent.

3. The electrochemical cell according to claim 2, wherein the tetraalkylammonium salts are tetraethylammonium salts or tetrabutylammonium salts.

4. The electrochemical cell according to claim 1, wherein the aprotic solvent is selected from the group consisting of acetonitrile, dimethyl sulfoxide, dimethylformamide, and propylene carbonate.

5. The electrochemical cell according to claim 4, wherein the aprotic solvent is acetonitrile.

6. The electrochemical cell according to claim 1, wherein the anode in the electrochemical cell is a sacrificial anode.

7. The electrochemical cell according to claim 6, wherein the anode in the electrochemical cell is a sacrificial zinc anode or a sacrificial aluminum anode.

8. The electrochemical cell according to claim 1, further comprising a catholyte inlet and a catholyte outlet.

9. The electrochemical cell according to claim 1, wherein the gas diffusion electrode comprises a metal or metal oxide catalyst.

10. The electrochemical cell according to claim 9, wherein the gas diffusion electrode comprises metal or metal oxide catalyst nanoparticles.

11. The electrochemical cell according to claim 9, wherein the metal or metal oxide catalyst comprises a metal catalyst selected from Pb, Ti, Fe, Mo, or combinations thereof.

12. The electrochemical cell according to claim 9, wherein the metal or metal oxide catalyst is provided on a porous support.

13. The electrochemical cell according to claim 12, wherein the metal or metal oxide catalyst is provided as finely dispersed nanoparticles on the porous support.

14. The electrochemical cell according to claim 12, wherein the porous support comprises hydrophobic carbon black agglomerates.

15. The electrochemical cell according to claim 1, wherein the gas diffusion electrode is a double-layer gas diffusion electrode comprising:

a catalyst layer comprising a metal or metal oxide catalyst; and a gas diffusion layer consisting of a hydrophobic porous material.

16. The electrochemical cell according to claim 15, wherein the hydrophobic porous material is polytetrafluoroethylene mixed with a pore former.

17. The electrochemical cell according to claim 15, wherein the gas diffusion electrode comprises a current collector.

18. The electrochemical cell according to claim 17, wherein the current collector consists of a layer of an electrochemically inert but conductive material.

19. The electrochemical cell according to claim 17, wherein the current collector consists of a layer of a graphite or a layer of stainless steel mesh.

20. A method for the electrochemical conversion of $CO_2$, the method comprising:

supplying $CO_2$ in gaseous form to the cathode of the electrochemical cell according to claim 1 through the catholyte.

* * * * *